US005173039A

United States Patent [19]

Cook

[11] Patent Number: 5,173,039

[45] Date of Patent: Dec. 22, 1992

[54] DOUBLE ACTING SIMPLEX PLUNGER PUMP

[76] Inventor: James E. Cook, 418 Rice St., Anoka, Minn. 55303

[21] Appl. No.: 766,331

[22] Filed: Sep. 27, 1991

[51] Int. Cl.[5] ..... F04B 21/02

[52] U.S. Cl. ..... 417/534; 417/415; 417/537

[58] Field of Search ..... 417/415, 454, 534, 535, 417/536, 537, 521

[56] References Cited

FOREIGN PATENT DOCUMENTS 1293065 3/1961 France ..... 417/535

*Primary Examiner*—Richard A. Bertsch
*Assistant Examiner*—Charles G. Freay
*Attorney, Agent, or Firm*—Roger W. Jensen

[57] ABSTRACT

A double acting simplex plunger pump comprising a pair of unique unitary combined stuffing box and head members pre-assembled with a double ended plunger, the subassembly being sandwiched between the axial end face of a drive motor and a flat surface of a unitary manifold means.

8 Claims, 4 Drawing Sheets

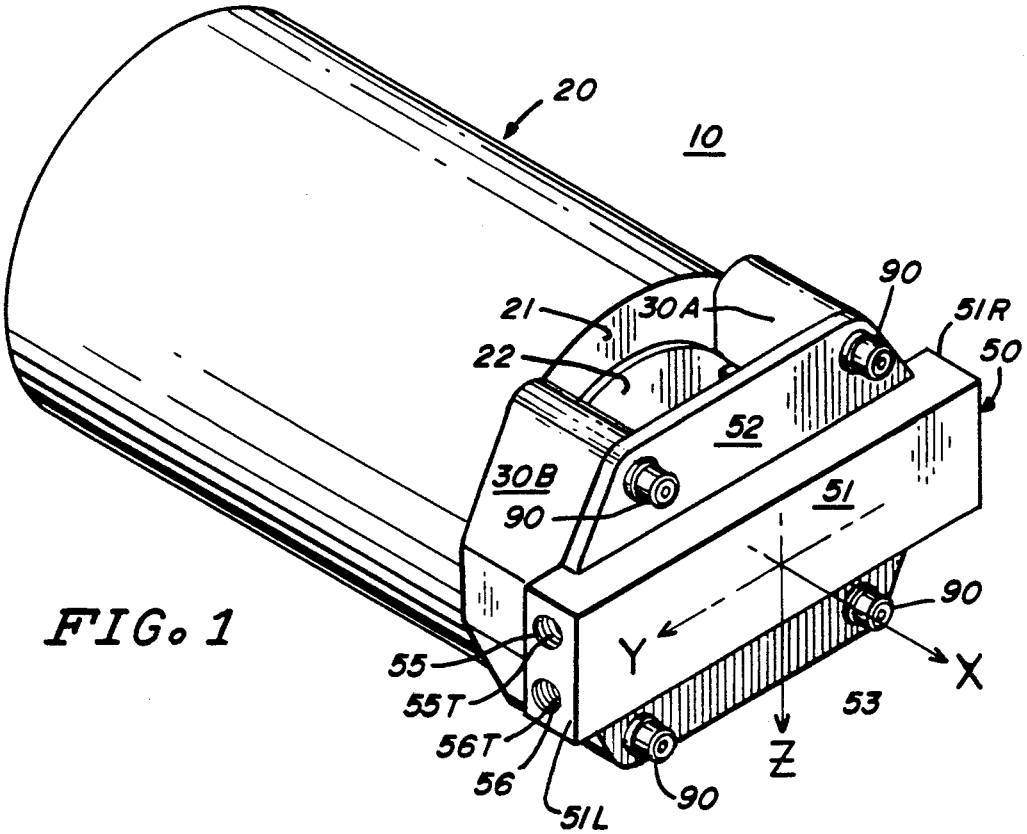
FIG. 1
FIG. 2
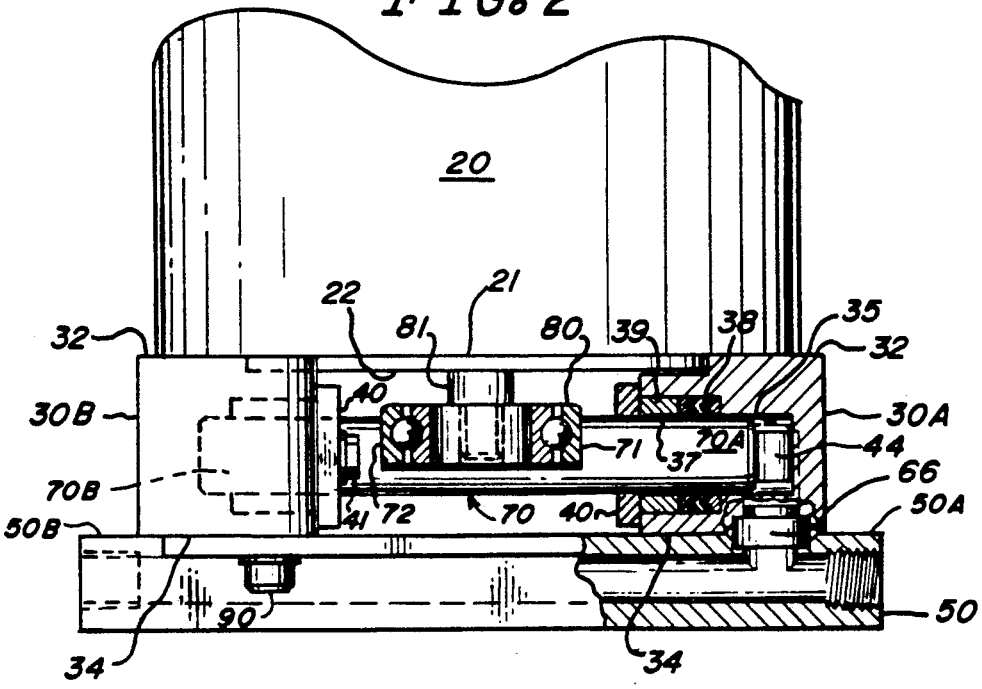

DOUBLE ACTING SIMPLEX PLUNGER PUMP

BACKGROUND OF THE INVENTION

My invention pertains to hydraulic pumps; the invention provides an improved pump and is generically applicable to double acting simplex plunger pumps of both broad categories, i.e., "plunger" and "piston" types.

The most relevant prior art of which applicant is aware is U.S. Pat. No. 4,978,284 granted Dec. 18, 1990, the present applicant being one of the coinventors of said prior art patent '284.

My prior art patent '284 provided a number of unique constructions and advantages over the prior art including that cited therein.

My present invention, in turn, provides additional very unique constructions and several very significant advantages over my prior '284 invention. For example, I am able in the present invention to eliminate the crankcase body 30 and the separate head members 80 of patent '284; the body 30 of '284 is a relatively expensive part because all bores therein require precision machining. Thus, one advantage of the present invention is to have fewer parts and thus reduce costs of manufacture and greater simplicity.

Another very significant advantage of my invention is to use the pump drive motor end plate or "end bell" as an integral component of the pump; all prior art pumps of which I am aware (including my prior '284 arrangement) use some form of adaptor means to provide a linkage between the electric drive motor and the pump apparatus. Thus, in patent '284 the crankcase body 30 was a form of adaptor to provide a linkage and connection between the motor 107 and the pumping apparatus, i.e., stuffing boxes 60, head members 80, manifold 50 and plunger member 96.

Another unique aspect of my invention is that I provide a specially shaped pair of unitary combined stuffing box and head members which, together with a double ended plunger member as a subassembly are sandwiched between the flat or planar axial end face of the drive motor and a bottom flat or planar surface of a unitary manifold member.

My unique pump design provides excellent and economical performance and is attainable at an extremely low manufacturing cost in comparison to all prior art pumps of which I am aware.

SUMMARY OF THE INVENTION

The present invention provides an improved double acting simplex plunger pump characterized by having excellent performance and very low manufacturing costs, the low cost stemming from the unique design which permits the pump to be made from a very low number of parts. Additionally the pump is very simple to assemble and to repair.

DESCRIPTION OF THE DRAWINGS

FIG. 1 is an isometric view of the assembled pump,

FIG. 2 is a view, partly in section, of the pump,

DESCRIPTION OF THE PREFERRED EMBODIMENT

Figure 4:
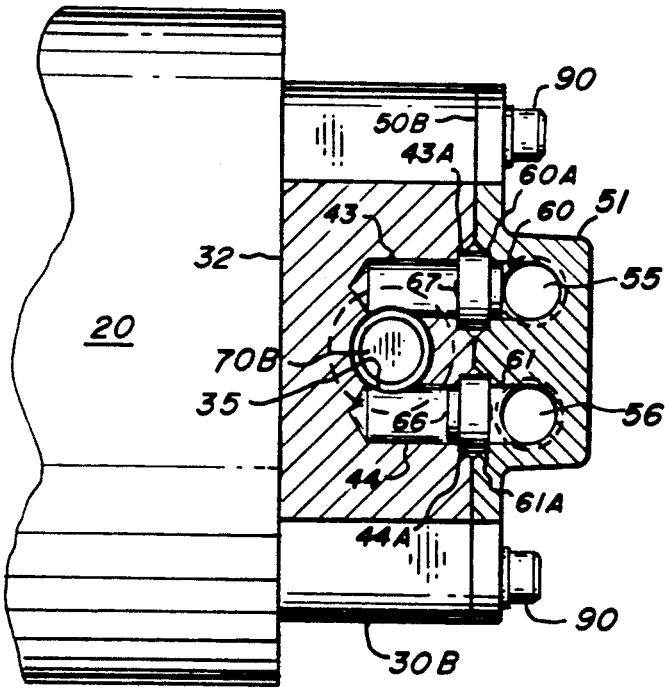
FIG. 4 is a transverse section of the manifold and one of the combined stuffing box and head members.

Referring to FIG. 1, the reference numeral 10 is used to designate the entire improved pump. In broad terms the pump comprises a motor mean 20, a pair of combined stuffing box and head members 30A and 30B, a manifold member 50, and a plunger member 70 (see FIG. 2). FIG. 1 also shows three mutually orthogonal axes X, Y and Z. The X axis is aligned with and/or parallel to the output rotational axis of the motor 20. The Y and Z axes are, for example, representative of the longitudinal axis and one of the transverse axes of the manifold 50. The Y axis is also parallel to the longtitudinal or reciprocational axis of the plunger member 70. Further the Y and Z axes define a plane which is parallel to several important surfaces of elements of the pump as will be described below.

Figure 7:
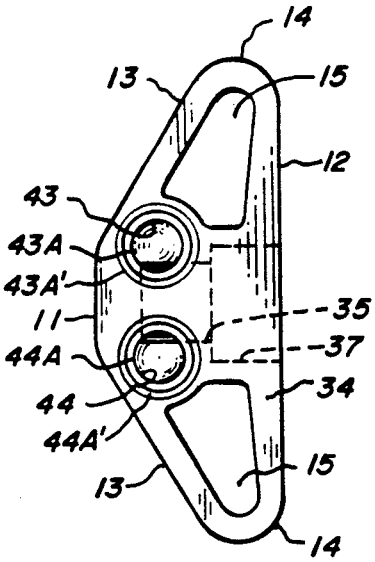
FIGS. 7, 8 and 9 are views of one of the two identical combined stuffing box and head members, FIG. 7 being a view of the side adapted to be in engagement with the manifold, FIG. 8 being a view of the transverse side that includes the plunger receiving recess, and FIG. 9 being a view of the side adapted to the engagement with the motor face.
Figure 8:
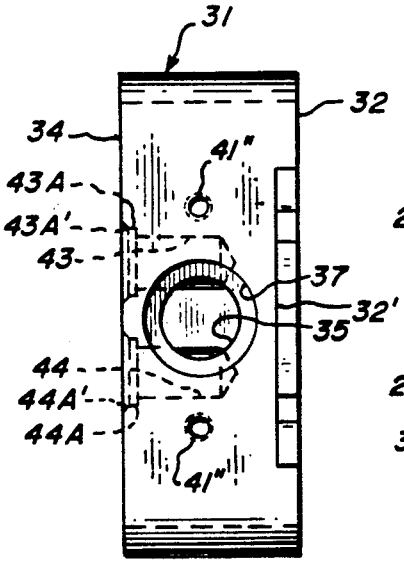
Figure 9:
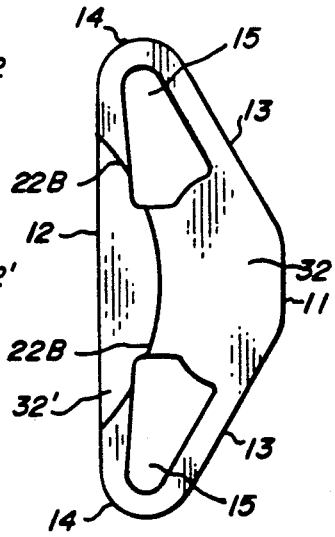

The combined stuffing box and head members 30A and 30B are identical subassemblies having identical piece parts and are arranged, as assembled and as shown in FIGS. 1 and 2, in a reverse or opposite sense as is apparent from the drawings. Each of the combined stuffing box and head members 30A and 30B comprises a unitary block 31, shown most clearly in FIGS. 7–9, having two spaced apart and parallel surfaces 32 and 34, shown best in FIGS. 2 and 8. The flat surface 32 is also designated as a motor end plate engaging surface; the flat surface 34 is designated a pump manifold engaging surface. The unitary block 31, as shown most clearly in FIG. 8, has a constant width between the aforedescribed parallel surfaces 32 and 34. As clearly shown in FIGS. 1, 2 and 3 when the members 30A and 30B are in asembled position, then the parallel surfaces 32 and 34 are also parallel to the aforementioned Y-Z plane and the members 30A and 30B are spaced apart from one another along the longitudinal plunger axis. The other two sides of the block 31, i.e., transverse to sides 32 and 34, and as shown in FIGS. 7 and 9, are defined by the block having a relatively thick center portion bounded by two generally parallel surfaces 11 and 12. Surface 11 is relatively short and surface 12 extends substantially the entire length. A pair of sloping sides 13 extends from the ends of surface 11 in the direction of surface 12. The juncture of surfaces 12 and 13 is a rounded connection designated by reference numeral 14. A pair of large apertures 15 are provided and are shown in FIGS. 7 and 9.

The block 31 is preferably made from an extrusion of a suitable aluminum alloy such as 6061 aluminum with each block being a slice from the extrusion with the flat parallel surfaces 32 and 34 resulting from the slicing process. Thus a basic extrusion is obtained having the aforementioned external surfaces 11, 12, 13 and 14 as well as the large apertures 15. The "slicing" step will be understood by those skilled in the art to include, by way of example, sawing, milling, and grinding.

Each combined stuffing box and head member also includes a deep recess 35 in the block 31 formed by precision boring and extending inwardly from surface 12 (see FIGS. 7 and 8) for receiving one of the ends 70A and 70B of the cylindrically shaped and reciprocating plunger 70, as shown in FIG. 2. The recesses 35 have a circular cross section with a preselected diameter to snuggly receive but not contact the ends 70A and 70B of the plunger. When members 30A and 30B are in the aforesaid assembled position shown in FIGS. 1–3 the longitudinal axes of the recesses 35 of both blocks 31 are in alignment and thus have a common longitudinal axis lying parallel to the reference axis Y and between the spaced apart parallel surfaces 32 and 34. The diameter and the longitudinal length of the recess 35 are preselected to provide the desired pumping performance.

Figure 10:
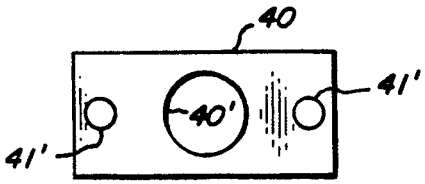
FIG. 10 is a view of the plunger guide and seal retainer.

Each block 31 has an additional plunger guide and stuffing recess 37 concentric with the recess 35 and of a larger diameter for receiving a high pressure seal assembly 38 and a plunger guide or bearing 39. The seal 38 and plunger guide 39 are retained in the assembled relationship shown in FIG. 2 by a rectangularly shaped retainer 40 (see FIG. 10) having a centrally positioned opening 40' for accommodating but not contacting or restraining the reciprocating plunger. The retainer 40 is affixed to the block 31 by suitable attachment means such as machine screws 41 (shown in FIGS. 2 and 3) which pass through apertures 41' of retainer 40 and screw into threaded bores 41' of block 31 (see FIG. 8).

Each combined stuffing box and head member 30A and 30B further comprises a set of first and second pump port recesses 43 and 44 which start at the pump manifold engaging surface 34 and extend preferably perpendicularly into the block 31 a sufficient preselected distance so as to be in connective relationship with the plunger receiving recess 35, this being shown clearly in FIGS. 4 and 7. Recesses 43 and 44 are shown to have longitudinal axes which are parallel to each other and to the reference axis X. Recesses 43 and 44 further are located symmetrically on opposite sides of the longitudinal axis of recess 35. Additional slightly larger diameter recesses 43A and 44A are provided concentric respectively with recesses 43 and 44 adjacent to surface 34 and provide a seat and one half of a combined enclosure for check valve means to be described below. Also, countersunk or beveled surfaces 43A' and 44A' are provided (as shown in FIG. 8) adjacent to 43A and 44A respectivley.

Figure 13:
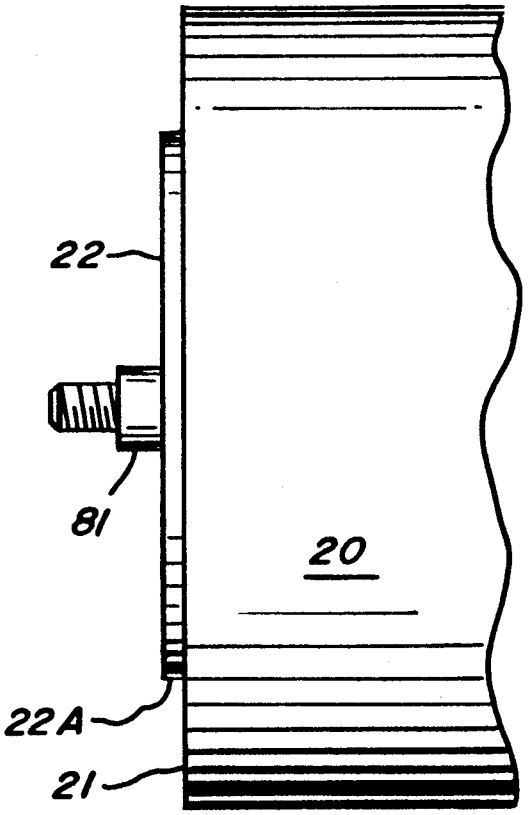
FIG. 13 is a side view of the motor means shown in FIG. 12 with only a portion of the motor depicted.
Figure 12:
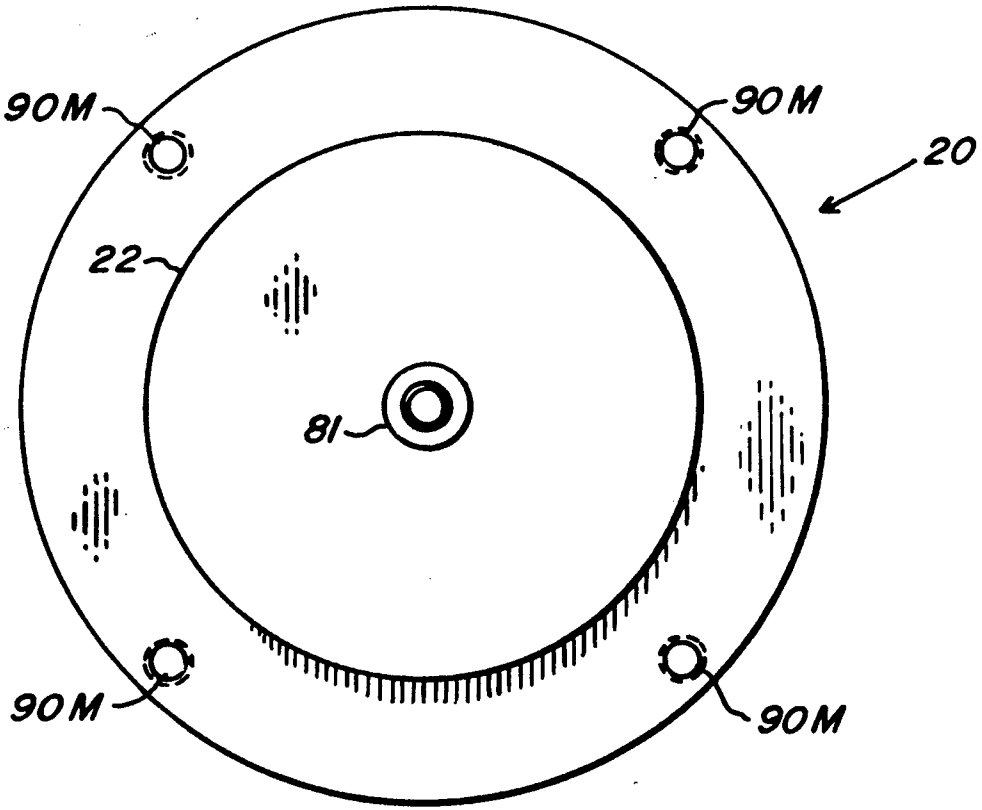
FIG. 12 is an end view of the motor means.

Each block 31 has on surface 32 thereof an arcuate shaped recess providing a flat surface 32' which is parallel to the primary surface 32 and with an arcuate surface 22B selected so as to be of the same radius as 22A of shoulder portion 22 of the motor, as shown in FIGS. 12 and 13.

Figure 5:
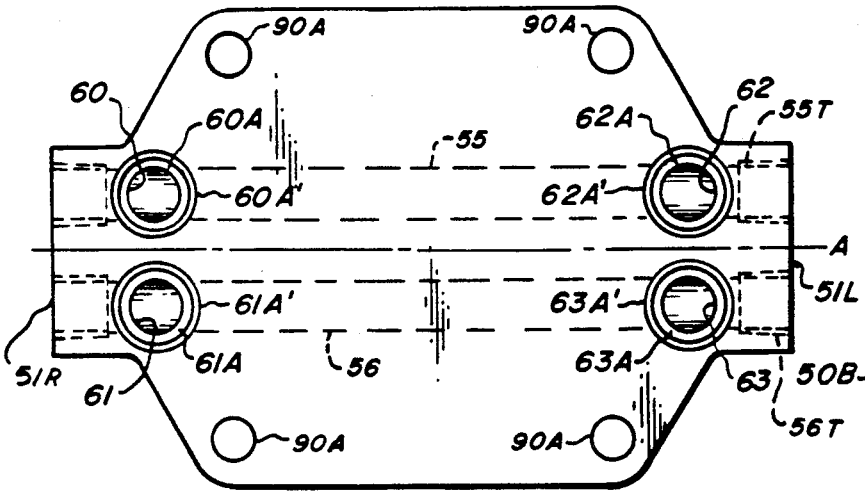
FIGS. 5 and 6 are bottom and end views respectively of the manifold.
Figure 6:
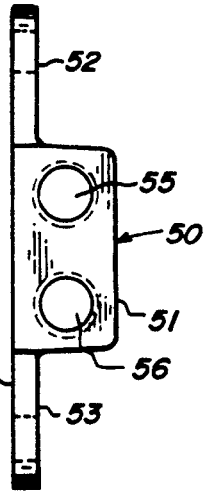

The manifold 50 is a unitary member having a flat rectangular shape with a longitudinal axis A, shown in FIG. 5 and parallel to reference axis Y. The manifold member 50 has a central relatively thick portion 51 extending the full length and a pair of relatively thin flange portions 52 and 53 extending from opposite sides of portion 51 as best shown in FIG. 6. First and second spaced apart manifold inlet/outlet ports 55 and 56 extend longitudinally through the entire central portion 51 from a first end 51L to a second end 51R (see FIGS. 1 and 5). The manifold inlet/outlet ports 55 and 56 are mutually parallel to the manifold longitudinal axis (also reference axis Y) and the ends of the ports 55 and 56 adjacent to ends 51L and 51R are threaded or equivalent as at 55T and 56T to receive appropriate inlet and outlet piping. In practice, there typically would be one inlet and one outlet; in this case the two unused ports would be sealed off with standard plugs. Alternately there could be a double inlet and a double outlet. Additional inlets and outlets may be provided along and perpendicular to ports 55 and 56.

Importantly the manifold member 50 has a bottom flat surface 50B (FIG. 6) which is adapted to be abutted by said pump manifold engaging surfaces 34 of the combined stuffing box and head members 30A and 30B as is best shown in FIGS. 2 and 4. The manifold 50 is preferably made of the same material as block 31 and is formed by an extrusion process whereby the longitudinal ports 55 and 56 are integral with the extrusion, i.e., formed by the extrusion process.

Communicating with the longitudinally extending ports 55 and 56 in the manifold are two sets of transversely extending ports, the first set being adjacent end 51R and identified by reference numerals 60 and 61 (for coaction with pump port recesses 43 and 44 of combined stuffing box and head member 30B). The second set of transversely extending manifold ports are adjacent end 51L and is identified by reference numerals 62 and 63. Port set 62/63 is intended for coaction with the pump port recesses 43 and 44 of combined stuffing box and head member 30A. Port sets 60/61 and 62/63 are preferably provided by a boring or drilling operation and are longitudinally spaced apart a preselected distance so that when the manifold is in an assembled relationship as shown in FIGS. 1–4, each of said sets of ports 60/61 and 62/63 will be in alignment with and in register with a set of pump port recesses 43 and 44 in members 30A and 30B respectively.

Figure 11:
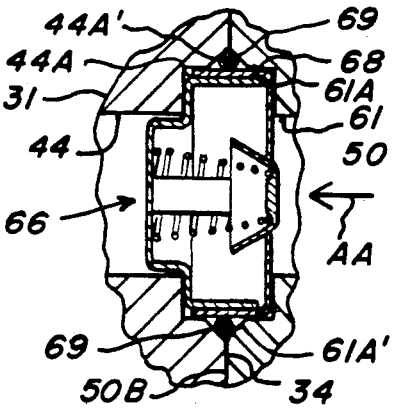
FIG. 11 is a view on an enlarged scale of one of the two indentical check valves used in the pump.

The sets of manifold transverse ports 60/61, and 62/63 have associated additional and slightly larger recesses concentric therewith and are identified respectively by reference numerals 60A, 61A, 62A and 63A, these additional recesses are concentric with ports 60–63 respectively and are of a preselected diameter and of an axial depth (together with recesses 43A and 44A) to provide a combined enclosure (see FIG. 4) for check valve means identified by reference numerals 66 and 67. Check valve 66 is shown enlarged in FIG. 11. Check valves 66 and 67 as indicated are identical and are of standard form and function, i.e., they have a cylindrical shape with an outer circumferential surface 68 and of a short axial length. In FIG. 11 the directional arrow AA designates the direction of fluid flow through the check valve means upon a pressure differential being applied across the axial ends of the check valve, as is well understood by those skilled in the art. An O ring 69 is provided encompassing the outer circumferential surface 68.

As indicated, the check valves 66 and 67 are positioned between the manifold and members 30A and 30B in opposite senses as is clearly shown in FIG. 4. As shown, check valve 66 will admit fluid flow from manifold port 56 through check valve 66 and thence, via 44, into plunger recess 35 while check valve 67 permits fluid flow of the reverse sense, i.e., from plunger recess 35 through passageway 43, check valve 67 into manifold port 55.

As indicated above, the manifold recesses 60A, 61A, 62A and 63A in conjunction with the two sets of recesses 43A and 44A of members 30A and 30B provide a combined enclosure for the check valve means 66 and 67. Beveled surfaces 60A', 61A', and 63A' are provided adjacent recesses 60A-63A respectively and essentially are of the same diameter but of reverse slope of means 43A' and 44'; Thus, the combined enclosure has a circumferential "V shaped" recess for receiving the O ring 69, as shown best in FIGS. 4 and 11.

For the purpose of the present invention, the check valves 66 and 67 are shown primarily for their valving function, as above described. However, the valves 66 and 67 as shown have two additional very important functions which briefly are (i) providing a precision alignment means and (ii) providing a structural or holding means for assisting the holding of the entire assembly together; these additional functions are claimed and described and discussed in much greater detail in a copending patent application of James E. Cook and Harald S. Erickson, Ser. No. 07/766,323, Filed Sep. 27, 1991, i.e., filed concurrently with this application.

The plunger 70 (see FIGS. 2 and 3) comprises a unitary cylindrical shaft having a preselected longitudinal length with first and second plunger means on the ends thereof; it will be understood that (as shown) the actual pumping function is provided by the snug but noncontacting fit of the plunger shaft into the coacting plunger receivign recess 35 of the combined stuffing box and head. Thus the ends of the plunger member, when the same is reciprocated, provide an alternating pumping action by displacing fluid in the receiving recess 35, i.e., member 30A, and then at the other end, e.g., 30B; hence the designator "double acting". Other plunger or piston configurations may be used with this invention, e.g., see the arrangements depicted in FIGS. 19 and 20 of the aforesaid prior U.S. Pat. No. 4,978,284.

The mid section of the shaft 70 is cut away as is shown in FIG. 2 providing two shoulder-like surfaces 71 and 72 which are adapted to be engaged by a crank eccentric or cam means 80 which is connected to the end of a rotatable shaft 81 of the motor means 20. Cam means 80 is shown in a "12 o'clock" position in FIG. 3. The variation or extent of the eccentric directly varies the pump displacement.

Figure 3:
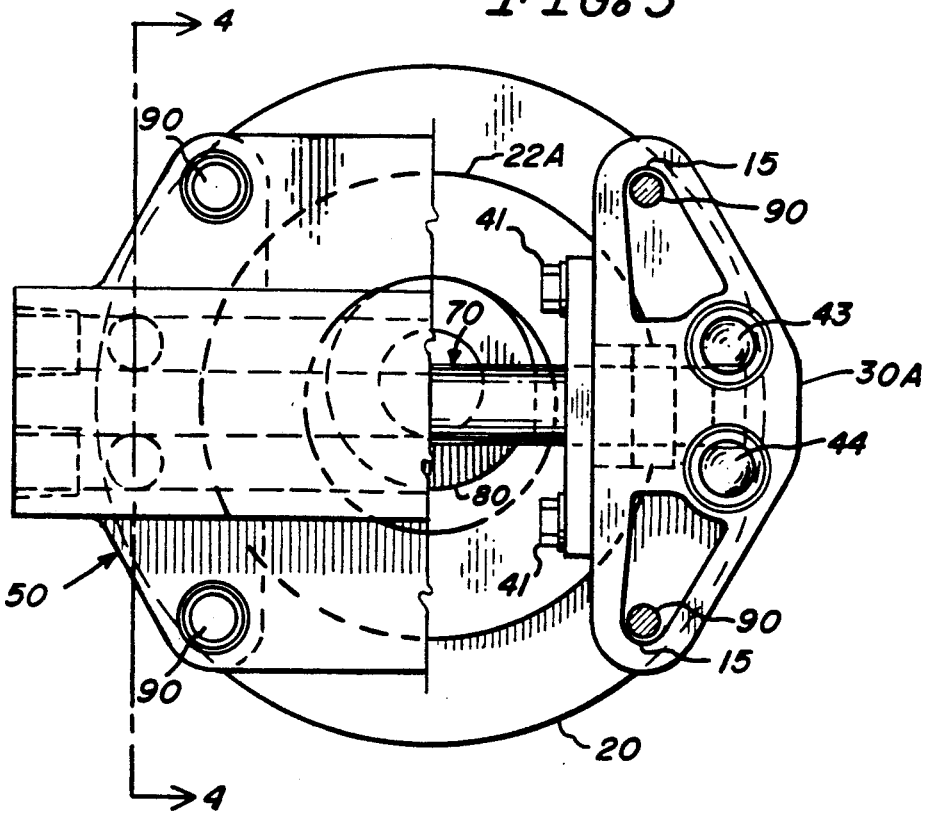
FIG. 3 is an end view, partly in section, of the apparatus shown in FIG. 2, with a portion of the manifold removed.

As shown motor means 20 is representative of electric motors (A.C. and D.C.) having an output rotatable shaft. However, the invention may be used with other motors such as hydraulic and pneumatic. The motor means 20 has a planar axial end face or surface 21 with a central axially extending shoulder portion 22 having a circumferential surface 22A. The rotational axis of shaft 81 is perpendicular to the planar end face 21. The combined stuffing box and head members 30A and 30B are spaced apart as shown in FIGS. 1, 2 and 3 and preassembled with the plunger member 70 and such subassembly is then clamped between the planar axial end face 21 of the motor 20 and the manifold 50, as shown clearly in FIG. 2, by having the surfaces 32 in abutting engagement with surface 21 of the motor and by having surfaces 34 in abutting engagement with manifold planar surface 50B. During said assembly, the arcuate surfaces 22B coact with the circumferential surface 22A of the shoulder 22 of the motor 20. Thus, planar surfaces 32' of 30A and 30B will be abutting against portions of the planar axial end surface 21 and arcuate surfaces 22B of 30A and 30B will be abutting against portions of the circumferential surface 22A.

Means are provided to absorb the energy of the reciprocation of the plunger 70, i.e., (i) the clamping of members 30A and 30B (at arcuate surfaces 22B thereof) against the arcuate surface 22A of shoulder portion 22 of motor means 20, and (ii) the aforedescribed linkage of manifold 50, members 30A and 30B check valves 66 and 67, and the motor means. Further, the check valves 66 and 67, per se, act on friction as energy absorbers.

As indicated, one category of motor means which may be used as an element of the invention is an electric motor of the type commercially available in numerous sizes and power ratings from several different suppliers; such motors usually have a shoulder means similar to shoulder 22 and the arcuate surface corresponding to 22A of such motors are usually held to close low or small tolerances in order to meet customer requirements. This invention takes advantage of said low tolerance of surface 22A by using this surface as the reference for the pump design, regard being given to the clamping of arcuate surfaces 22B of members 30A and 30B against surface 22A all as aforesaid.

While the preferred embodiment of the invention uses the contact or engagement of (i) surface 22A with surface 22B and (ii) surface 21 with surface 32, the scope of the invention includes, if desired, an engagement or contact of surface 22 of the motor means with surface 32' of members 30A and 30B in addition to or in place of the engagement of surfaces 21/32.

The members 30A and 30B thus are key to the unique construction of my invention. By having them constructed from identical blocks 31 (and with surfaces 32 thereof abutting surface 21 of the motor means) with the axes of recesses 35 and the end surfaces 32 and 34 being mutually parallel, (and also parallel to the Y-Z plane) then a first very important criteria is satisfied, i.e., the longitudinal axes of the two recesses 35 are parallel to the planar surface 21 of the motor means 20.

The next key construction feature is that the members 30A and 30B are oriented with respect to each other so that the aforesaid longitudinal axes of the recesses 35 are in precise alignment; the resultant common axis thus defines the reciprocational or longitudinal axis for the plunger 70.

As indicated, the shaft 81 rotational axis is perpendicular to end face 21. Thus the plunger axis is perpendicular to the shaft 81 rotational axis.

The engagement of arcuate surfaces 22B of 30A and 30B with circumferential surface 22A of the motor means sets or determines the spacing between 30A and 30B along the plunger axis.

Means are provided by my invention to hold members 30A and 30B from moving away from one another along the plunger axis as a reaction to the force, i.e., reciprocating energy, of the reciprocating plunger moving into the recesses 35; said means, in broad terms, includes the manifold and, in general, a connection between the manifold, the members 30A and 30B and the motor means. The specific holding arrangement depicted is for a preferred embodiment of the invention and includes the manifold being connected to (i) members 30A and 30B as aforesaid, i.e., the two sets of check valves 66 and 67 residing in the combined enclosures, and (ii) the motor end face by four machine screws 90 having head means abutting the outboard surfaces of flanges 52 and 53 of the manifold and extending parallel to the reference axis X through apertures 15 of the combined stuffing box and head members 30A and 30B and into appropriate threaded recesses 90M in the axial end face 21 of the motor 20; the specific arrangement depicted is specifically claimed in the aforesaid copending application.

It is to be understood that the embodiment of my invention shown is only for the purpose of illustration and that my invention is limited solely by the scope of the appended claims.

I claim as my invention:

1. A double acting simplex plunger pump comprising:

a) first and second unitary combined stuffing box and head members each member comprising (i) a unitary block having two spaced apart and parallel surfaces respectively designated a motor end face engaging surface and a pump manifold engaging surface, (ii) a recess in said block for receiving a cylindrically shaped plunger, said recess having a circular cross section and a longitudinal axis lying parallel to and in between said spaced apart parallel surfaces, (iii) a set of first and second pump port recesses in said block and each extending from said pump manifold engaging surface into said block and into connective relationship with said plunger receiving recess, and (iv) first and second check valve means respectively and reversely positioned in said first and second pump port recesses so that said first check valve means will admit fluid flow from said plunger recess and so that said second check valve means will admit fluid flow toward said plunger recess, b) a manifold having a longitudinal axis, a bottom flat surface adapted to be abutted by said pump manifold engaging surfaces, first and second transversely spaced apart manifold inlet/outlet ports extending longitudinally therethrough from a first end to a second end and being mutually parallel to said longitudinal axis, and first and second longitudinally spaced apart sets of ports connecting said manifold inlet/outlet ports to said bottom flat surface, c) plunger means comprising a shaft having a longitudinal axis and a preselected longitudinal length, first and second pumping means on the ends thereof, and a centrally located crank engaging means, d) motor means having a planar axial end face, an output shaft rotatable about a shaft axis and extending axially from and perpendicular to said end face, and crank means on an end of said shaft, and e) means connecting said members, said manifold, said plunger and said motor means, whereby: (i) said members are preassembled with said plunger means with said first and second pumping means of said plunger means being disposed in said plunger receiving recesses, (ii) said members are spaced apart along said plunger longitudinal axis a preselected longitudinal length, (iii) said motor end face engaging surfaces of said members are abutting said planar axial end face of said motor means, (iv) said pump manifold engaging surfaces of said members are abutting said bottom flat surface of said manifold, (v) said two sets of first and second pump port recesses of said members are respectively in register with said first and second longitudinally spaced apart sets of ports in said manifold, and (vi) said crank means is operatively connected to said crank engaging means of said plunger means.

2. Apparatus of claim 1 further characterized by each member having means adjacent to said motor end face surface adapted to engage cooperative means adjacent to said motor means planar end face, to thereby position the members longitudinally with respect to said plunger means and also with respect to said motor means output rotatable shaft.

3. Apparatus of claim 2 whereby said cooperative means comprises (i) circular shoulder means on said motor end face and (ii) arcuate-shaped recesses in said motor end face surfaces of said members.

4. Apparatus of claim 1 further characterized by said connecting means including means for positioning said members on opposite sides of said output rotatable shaft and with said member recess longitudinal axes in alignment and perpendicular to said shaft axis.

5. Double acting simplex plunger pump apparatus adapted to be assembled with a motor means having a planar axial end face, an output shaft rotatable about a shaft axis and extending axially from and perpendicular to said end face, and crank means on the end of said shaft, said pump apparatus comprising:

a) first and second unitary combined stuffing box and head members each member comprising (i) a unitary block having two spaced apart and parallel surfaces respectively designated a motor end face engaging surface and a pump manifold engaging surface, (ii) a recess in said block for receiving a cylindrically shaped plunger, said recess having a circular cross section and a longitudinal axis lying parallel to and in between said spaced apart parallel surfaces, (iii) a set of first and second pump port recesses in said block and each extending from said pump manifold engaging surface into said block and into connective relationship with said plunger receiving recess, and (iv) first and second check valve means respectively and reversely positioned in said first and second pump port recesses so that said first check valve means will admit fluid flow from said plunger recess and so that said second check valve means will admit fluid flow toward said plunger recess, b) a manifold having a longitudinal axis, a bottom flat surface adapted to be abutted by said pump manifold engaging surfaces, first and second transversely spaced apart manifold inlet/outlet ports extending longitudinally therethrough from a first end to a second end and being mutually parallel to said longitudinal axis, and first and second longitudinally spaced apart sets of ports connecting said manifold inlet/outlet ports to said bottom flat surface, c) plunger means comprising a shaft having a longitudinal axis and a preselected longitudinal length, first and second pumping means on the ends thereof, and a centrally located crank engaging means, and d) means for connecting said members, said manifold and said plunger to said planar axial end face of said motor means, whereby: (i) said members are preassembled with said plunger means with said first and second pumping means of said plunger means being disposed in said plunger receiving recess, (ii) said members are spaced apart along said plunger longitudinal axis a preselected longitudinal length, (iii) said motor end face engaging surfaces of said members are abutting said planar axial end face of said motor means, (iv) said pump manifold engaging surfaces of said members are abutting said bottom flat surface of said manifold, (v) said two sets of first and second pump port recesses of said members are respectively in register with said first and second longitudinally spaced apart sets of ports in said manifold, and (vi) said crank means is operatively connected to said crank engaging means of said plunger means.

6. Apparatus of claim 5 further characterized by each member having means adjacent to said motor end face surface adapted to engage cooperative means adjacent to said motor means planar end face, to thereby position the members longitudinally with respect to said plunger means and also with respect to said motor means output rotatable shaft.

7. Apparatus of claim 6 whereby said cooperative means comprises (i) circular shoulder means on said motor end face and (ii) arcuate-shaped recesses in said motor end face surfaces of said members.

8. Apparatus of claim 5 further characterized by said connecting means including means for positioning said members on opposite sides of said output rotatable shaft and with said member recess longitudinal axes in alignment and perpendicular to said shaft axis.

* * * * *